US007954639B2

(12) United States Patent
Carney et al.

(10) Patent No.: US 7,954,639 B2
(45) Date of Patent: Jun. 7, 2011

(54) DUGOUT ORGANIZER

(75) Inventors: Andrew Carney, McKinney, TX (US); Kenneth Buras, Spring, TX (US); John A. Carpinelli, Rockwall, TX (US)

(73) Assignee: Andrew Carney, McKinney, TX (US)

( * ) Notice: Subject to any disclaimer, the term of this patent is extended or adjusted under 35 U.S.C. 154(b) by 114 days.

(21) Appl. No.: 12/347,531

(22) Filed: Dec. 31, 2008

(65) Prior Publication Data

US 2009/0188819 A1 Jul. 30, 2009

Related U.S. Application Data

(60) Provisional application No. 61/018,053, filed on Dec. 31, 2007.

(51) Int. Cl.
*B65D 69/00* (2006.01)

(52) U.S. Cl. ..... 206/579; 211/60.1; 211/118; 206/315.1

(58) Field of Classification Search ..... 206/315.1, 206/579; 190/107–110, 119; 383/38–40; 108/149, 162; 211/113, 118, 149, 60.1, 85.7
See application file for complete search history.

(56) References Cited

U.S. PATENT DOCUMENTS

| | | | | |
|---|---|---|---|---|
| 2,244,887 | A * | 6/1941 | Manley | 190/107 |
| 4,629,065 | A * | 12/1986 | Braaten | 206/315.1 |
| 4,817,802 | A * | 4/1989 | Pratt | 206/579 |
| 5,224,602 | A * | 7/1993 | Bettles et al. | 206/579 |
| 5,337,907 | A * | 8/1994 | McKenzie et al. | 383/39 |
| 6,009,995 | A * | 1/2000 | Speck | 206/579 |
| 6,039,474 | A * | 3/2000 | DeChant | 190/109 |
| 2006/0037877 | A1 * | 2/2006 | Souza | 206/315.1 |
| 2006/0042976 | A1 * | 3/2006 | Hawthorne | 206/315.1 |
| 2008/0116160 | A1 * | 5/2008 | McNicholas | 211/118 |

* cited by examiner

*Primary Examiner* — Luan K Bui
(74) *Attorney, Agent, or Firm* — Alan Lintel

(57) ABSTRACT

A dugout organizer includes a plurality of compartments formed from a flexible material, wherein each of the compartments are sized to hold a player's glove, helmet and hat, a shelf for holding larger equipment coupled to the compartments, and a plurality of bat holders for holding bats. The compartments, shelf and bat holders can be folded into a relatively flat unit for transport.

34 Claims, 15 Drawing Sheets

DUGOUT ORGANIZER

CROSS-REFERENCE TO RELATED APPLICATIONS

This application claims the benefit of the filing date of copending provisional application U.S. Ser. No. 61/018,053, filed Dec. 31, 2007, entitled "DUGOUT ORGANIZER", which is incorporated by reference herein.

STATEMENT OF FEDERALLY SPONSORED RESEARCH OR DEVELOPMENT

Not Applicable

BACKGROUND OF THE INVENTION

1. Technical Field

This invention relates in general to sports equipment and, more particularly, to an organizer for holding players' equipment in a dugout.

2. Description of the Related Art

As outlying suburbs are developed surrounding major metropolitan areas, sports fields and complexes continue to be designed and constructed by municipalities and private entities to support the athletic interests of the community. In particular, large scale multi-field and multi-purpose complexes are being designed to accommodate the large number of kids and adults who participate in various sports and athletic activities. While these complexes and fields feature state of the art amenities, some features can be left out due to either being cost prohibitive or due to the potential risk of vandalism, thievery or abuse which would make them impractical for a facility to install.

With regard specifically to baseball/softball complexes and fields, most dugouts are designed to include only chain link fences and metal benches and without any type of device provided to organize the amount of game and player equipment that is used in organized baseball/softball. At the major league, minor league, collegiate and occasional high school level, team dugouts typically include custom wood built-in units that are designed to hold player equipment such as batting helmets and bats. Additionally, players of these corresponding age levels are old enough to care for their respective things in a responsible manner, are respectful of their teammate's equipment and have played long enough to know the traditional way that equipment is handled in a dugout. At the youth level, however, this behavior is not the case. The typical dugout at a community or municipal ball field complex during a baseball/softball game or practice consists of hats, gloves, bats, helmets, water bottles, bags and other equipment items strewn about the dugout bench and ground in a haphazard manner because there is no singular, dedicated space or device for orderly containment of the equipment. This situation repeats itself time and time again as the team/players go from fielding to batting during the course of a practice or game.

As such, players often take a long time to find their respective equipment, they mistakenly grab another player's equipment, or have their equipment damaged or soiled because it has been stepped on or spilled on.

Existing comparable products that are available to the consumer include plastic or metal hanging bat holders, hanging bat bags, hanging helmet bags, hanging bat and helmet bags, hanging helmet and glove bags, singular equipment hooks, equipment storage bags and organizers, and individual player equipment bags. With regard to the aforementioned items they are designed to contain/store either just one or two equipment items or the equipment of only one individual player. Several also have the intended secondary purpose of serving as a storage and equipment carry bag of the particular items. While the prior art function satisfactorily in their intended functions they are limited in their scope and fail to provide a comprehensive solution.

Accordingly, there is a need for a dugout baseball/softball equipment organizer that provides adequate storage space for each player on the team while remaining easy to store and transport to games.

BRIEF SUMMARY OF THE INVENTION

In the present invention, a dugout organizer includes a plurality of compartments formed from a flexible material, wherein each of the compartments are sized to hold a player's glove, helmet and hat, a shelf for holding larger equipment coupled to the compartments, and a plurality of bat holders for holding bats. The compartments, shelf and bat holders can be folded into a relatively flat unit for transport.

BRIEF DESCRIPTION OF THE SEVERAL VIEWS OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The present invention is best understood in relation to FIGS. 1-15 of the drawings, like numerals being used for like elements of the various drawings.

The present invention comprises various embodiments of a baseball/softball equipment dugout organizer for the temporary placement and organization of the players' personal equipment items generally used during the course of a baseball/softball game and practice. The organizer assists players with keeping track of their respective items e.g. hat, glove, batting helmet, bat, batting gloves, water bottle and other personal items in an orderly and consistent manner so that from game-to-game and practice-to-practice each player has a designated place for his/her items. The dugout organizer can be easily transported to and from the dugout and folds into a compact shape for storage while not being used.

Figure 1:
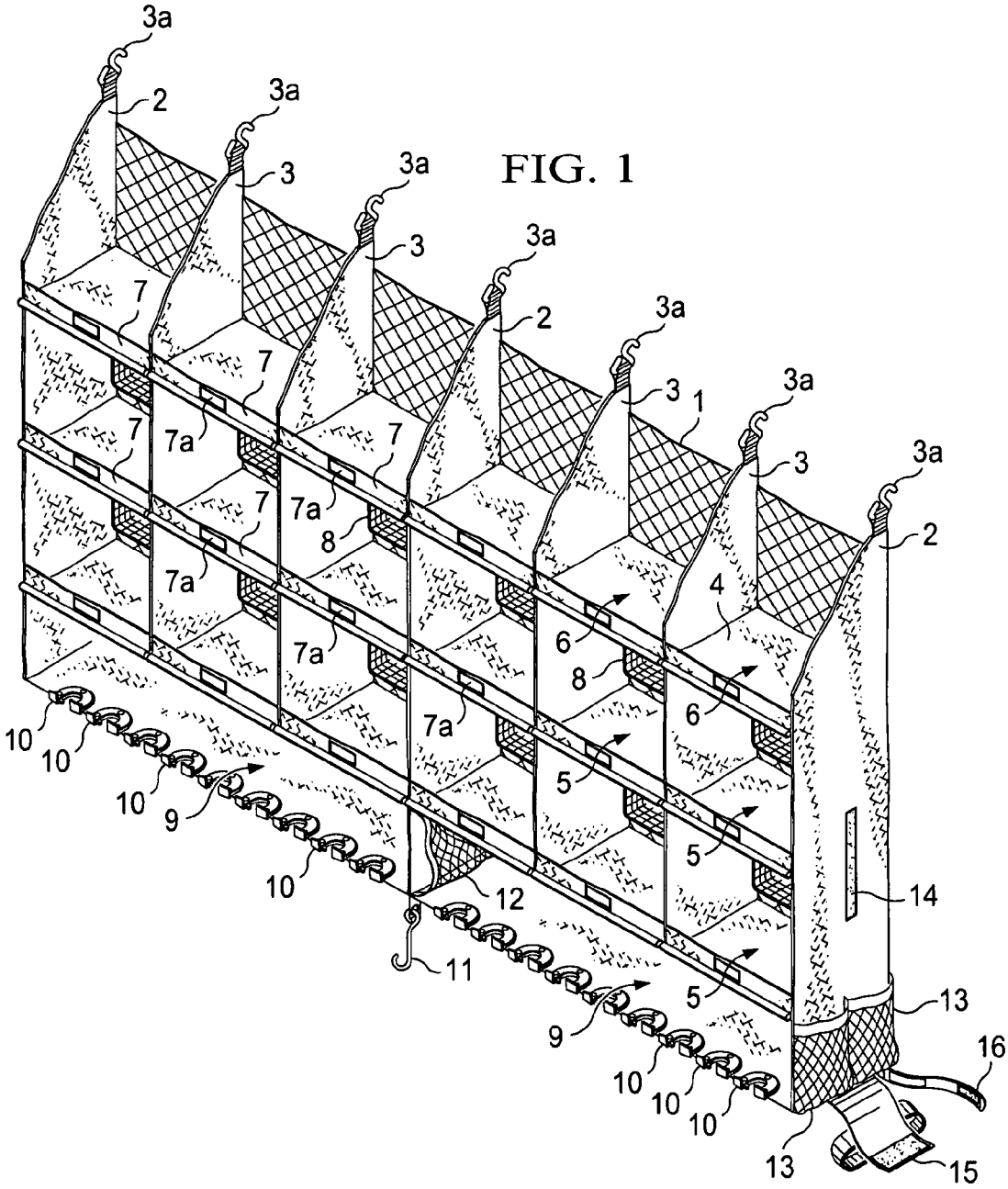
FIG. 1 is an overall view of the front side of the baseball/softball equipment dugout organizer.

FIG. 1 of the drawings provides an overall view of the organizer unit while empty from the front perspective. The organizer construction consists of a large back mesh material piece 1 approximately 36" tall×72" wide that is a mesh fabric with three full length vertical material panels 2, four ¾ length vertical material pieces 3 and horizontal material pieces 4 attached to it to form a grid of compartments 5,6 and shelves 9. Vertical material pieces have hooks 3*a* at the top to attach the organizer, for example, to a chain link fence or to other mounting hardware such as eye hooks or rods.

In the preferred embodiment, the compartments consist of twelve identically sized 5-sided compartments 5 with an open front for access (in two rows of six) and a top row of six 4-sided compartments 6 with an open top and front for access. Each of the aforementioned compartments is closed-out with a horizontal material section 7 which serves to improve the structural integrity of each compartment, provides a feature for preventing equipment from sliding out of the compartment, and provides a front-facing surface for display of an individual player's name plate 7*a*. The player compartments are sized accordingly to accommodate the storage of an individual player's glove, hat and batting helmet, which are those items most commonly found and used in the sports of baseball and softball. In the preferred embodiment, compartments 5 are approximately twelve inches wide by twelve inches deep by ten inches high, although a suitable compartment could vary slightly from those dimensions. Each 5-sided compartment also includes a water bottle storage feature 8 either stitched within or otherwise secured to the top, and side. There should be available space at the back of the compartment 5, 6 or bottle storage feature 8, to hold other personal items, such as keys and wallets.

Figure 15:
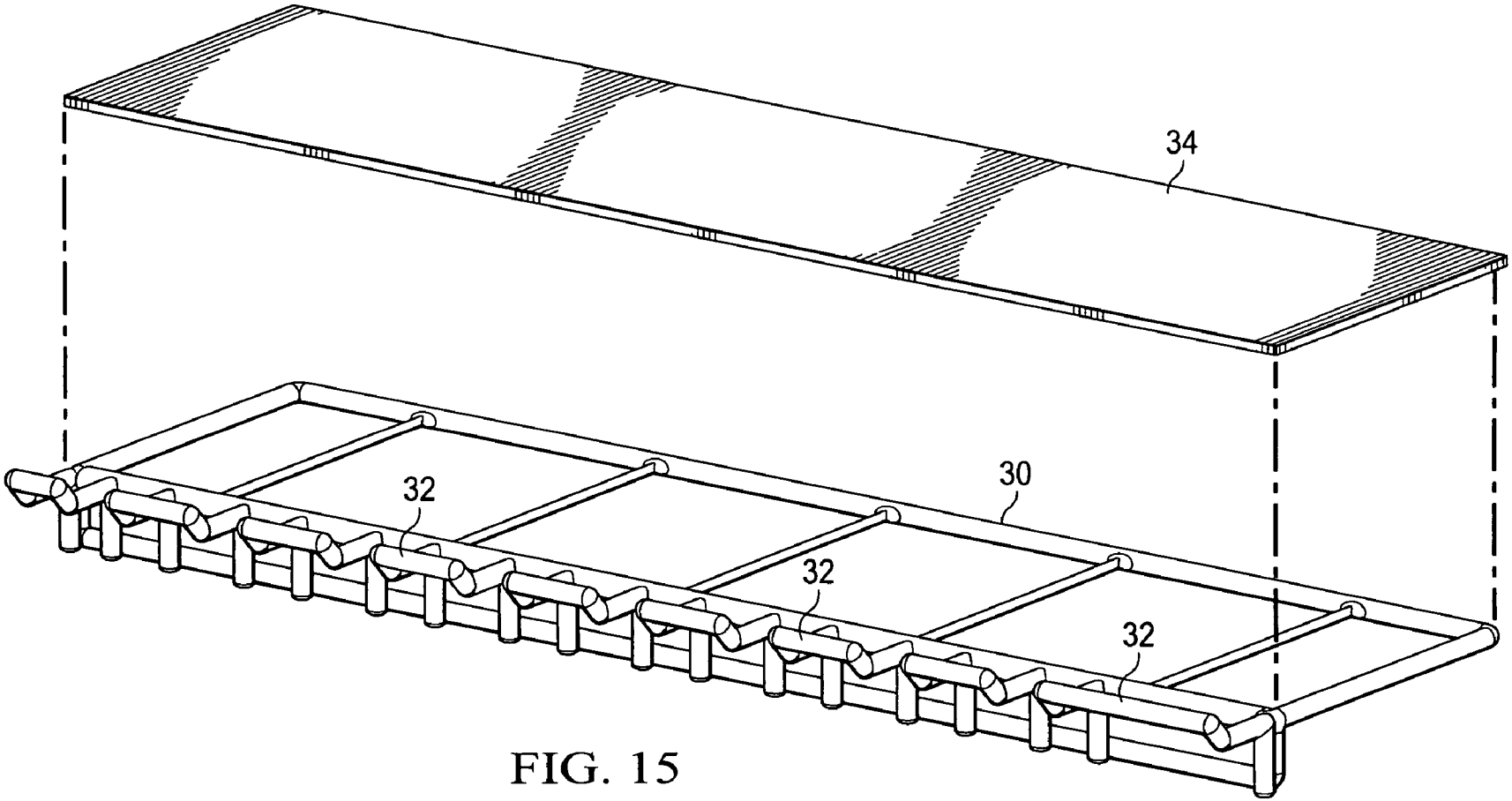
FIG. 15 illustrates an alternative embodiment for the bottom shelf and bat hanging mechanism.

Two bottom compartments are formed above a storage shelf 9. These compartments can be used for the placement of catcher's equipment items—chest protector, shin guards and related accessories—as well as a general catch-all location for other such items as may be found in a team dugout. Within the two bottom shelves are eighteen "bat grabbers" 10 designed for the hanging and securing of player bats. Thermo-formed or otherwise produced plastic parts with an inserted die-cut rubber catch are sewn, riveted or otherwise secured to the bottom shelves and positioned sufficiently apart from one another to allow for the convenient hanging and securing of player bats. An alternative embodiment for holding the bats is shown in FIG. 15. Secured below the center of the unit between the bottom compartments is a hang strap with a hook 11 for the hanging of the catcher's mask. Within one of the bottom compartments is attached a mesh pocket 12 for holding the unit's carry bag when the unit is in use.

Storage shelves 9 may use a flat, lightweight rigid material, such as a corrugated plastic material or a metal grid, shown in FIG. 15.

Positioned on the exterior sides of the unit are accessory mesh pockets 13 and a Velcro strip 14 for the securing of the line-up card holder accessory. These features are incorporated in the unit in the same location on both exterior sides. Pockets 13 and strip 14 may be provided on both sides of the organizer. At the edge of one side of the bottom compartments is secured the closure strap 15.

Figure 2:
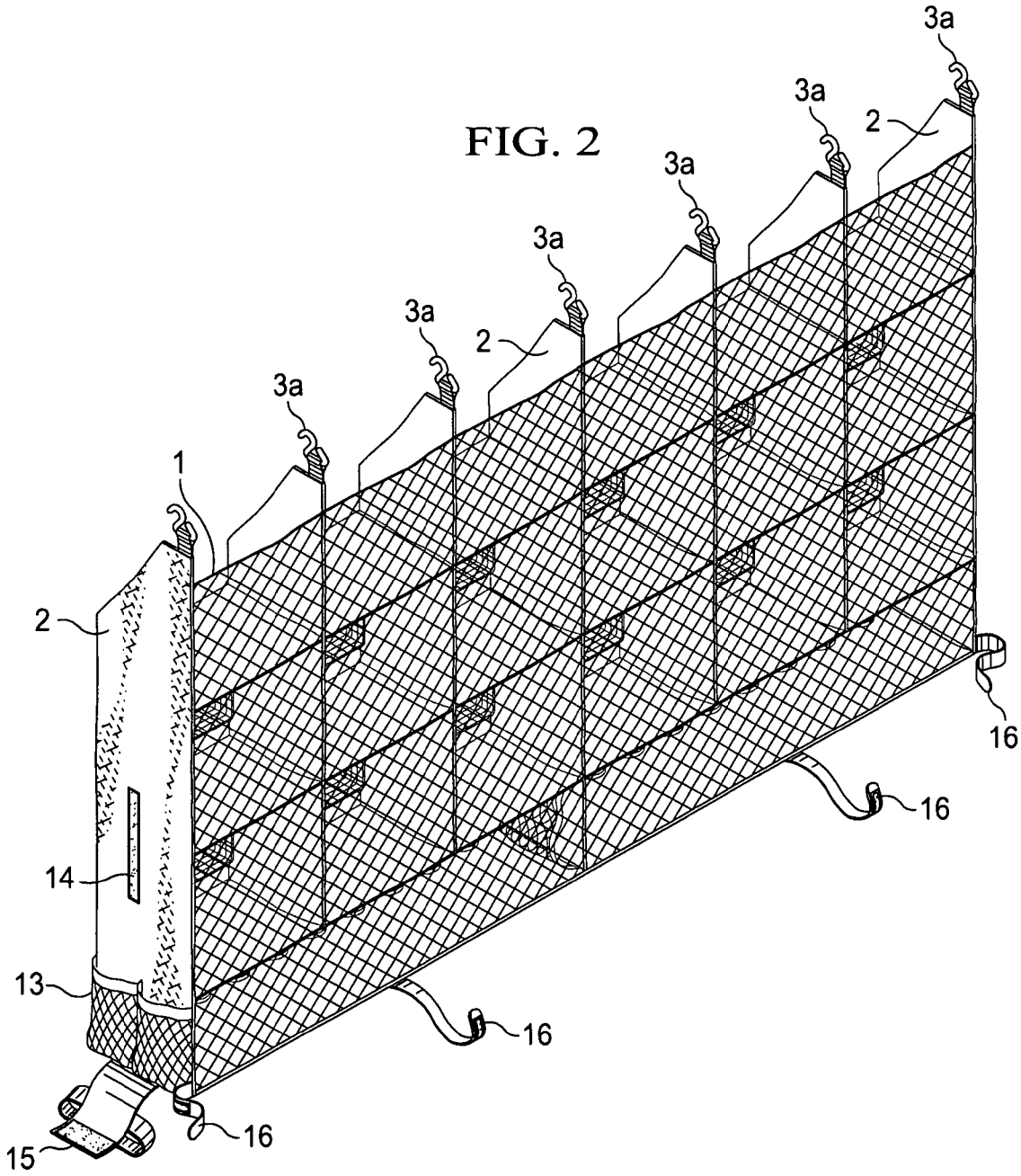
FIG. 2 is an overall view of the back side of the baseball/softball equipment dugout organizer.

FIG. 2 of the drawings indicates the location of the four tension straps 16 along the backside the unit that serve a dual purpose of holding the unit securely against the dugout fencing and providing a leveraged counterbalancing point to further stabilize the bat hanging feature and minimize forward lean caused by the weight of the hanging bats.

In operation, the organizer is held onto the fence by hooks 3*a* and straps 16. The mesh backing 1 allows the wind to pass through the organizer while secured to the fence to minimize flapping. Also, using the mesh backing 1 reduces the weight of the unit.

The general dimensions for the overall storage unit are approximately 72 inches wide, by 40 inches high, by 12 inches deep, it being understood that the dimensions could change as appropriate for the amount of equipment to be stored in the organizer, or the number of rows of compartments. For example, the organizer could be configured as two rows of compartments, each row having nine compartments.

Figure 3:
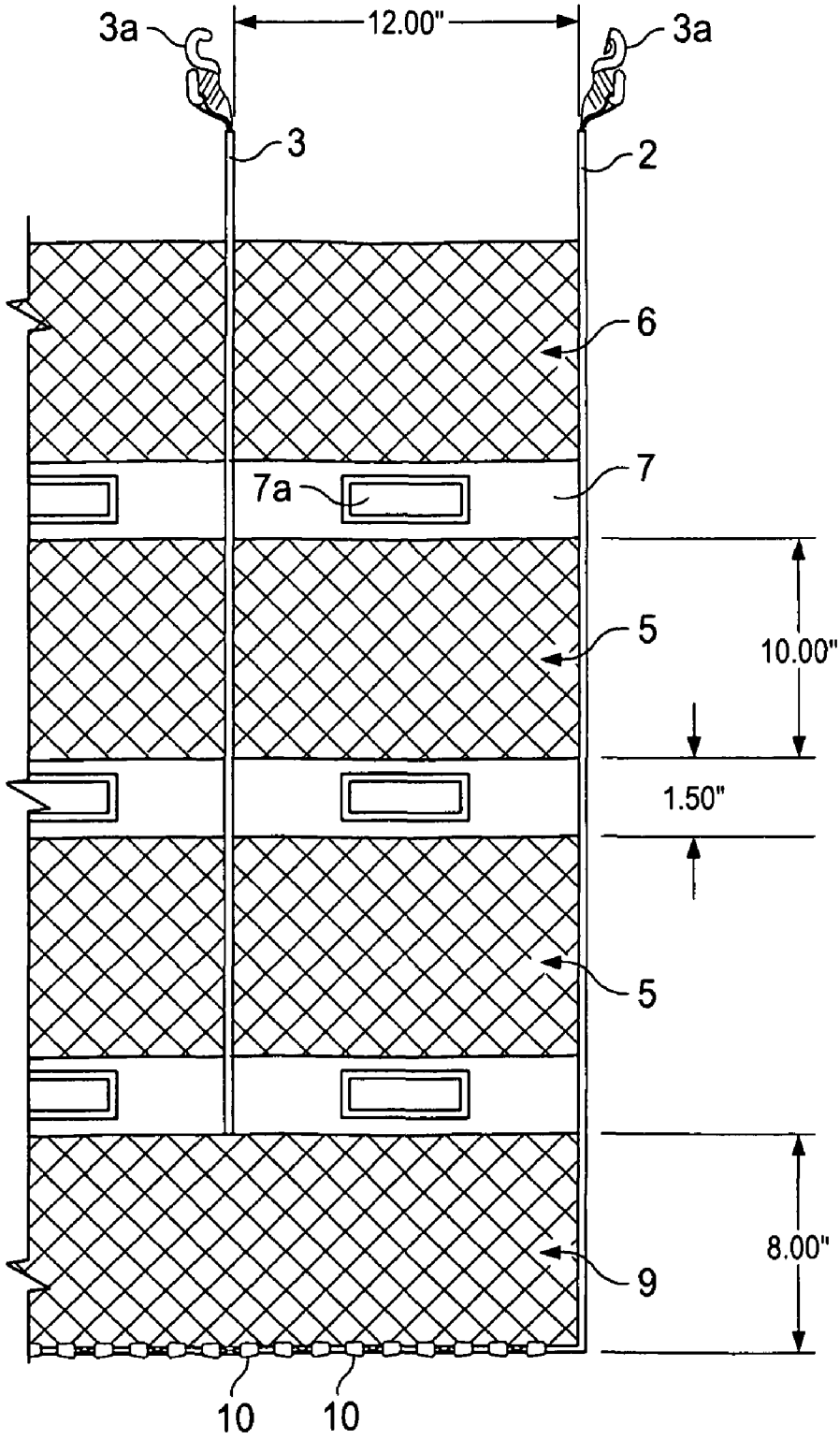
FIG. 3 is a detailed view of the baseball/softball equipment dugout organizer player compartments.

FIG. 3 illustrates general dimensions for the compartments 5 and 6 within the organizer. Again, these dimensions could be varied as desired.

Figure 4:
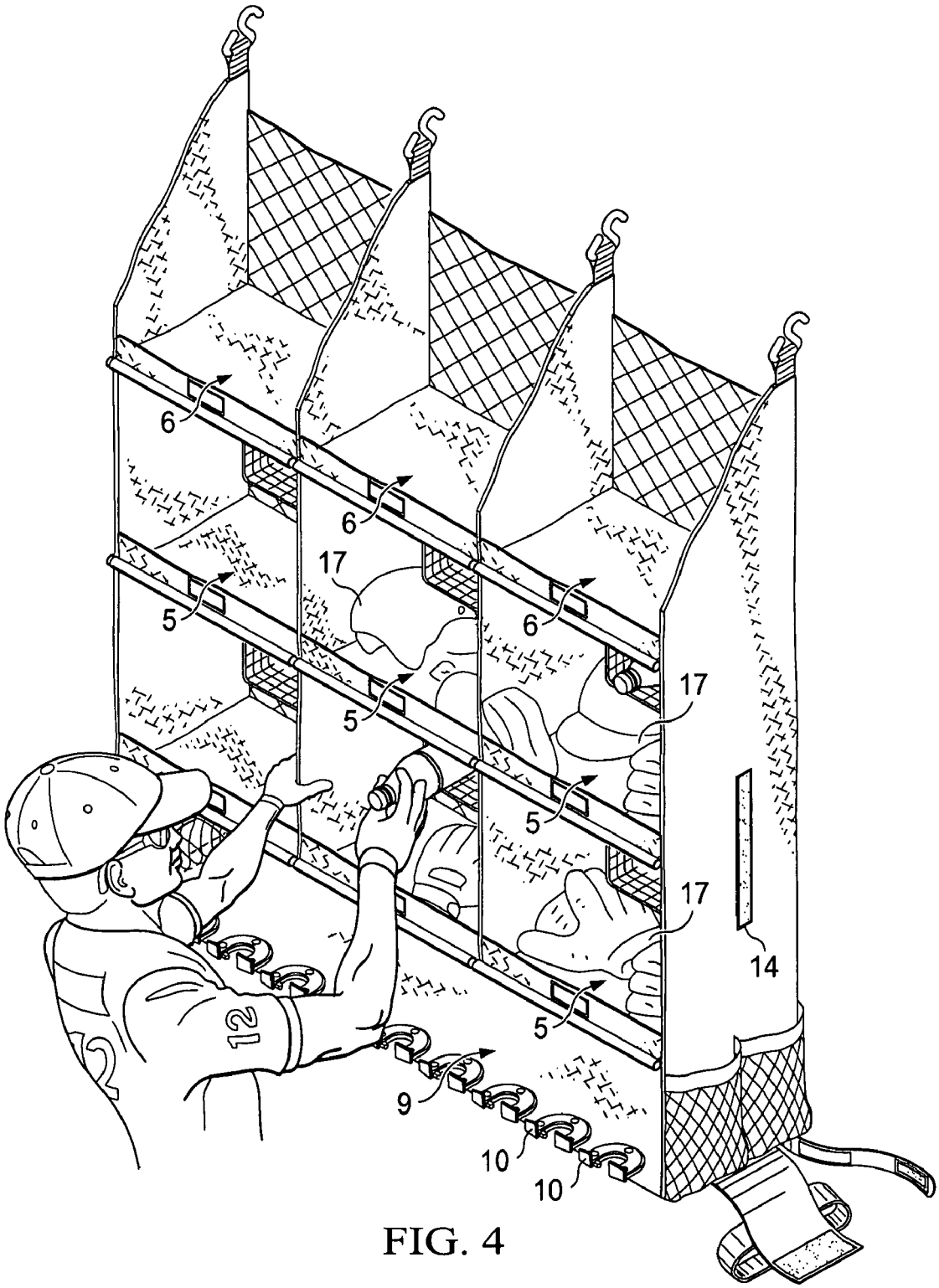
FIG. 4 illustrates the players' equipment in their respective compartments.

FIG. 4 of the drawings provides a rendering demonstrating the unit's functionality whereby the respective player compartments contain the player's equipment 17.

Figure 5:
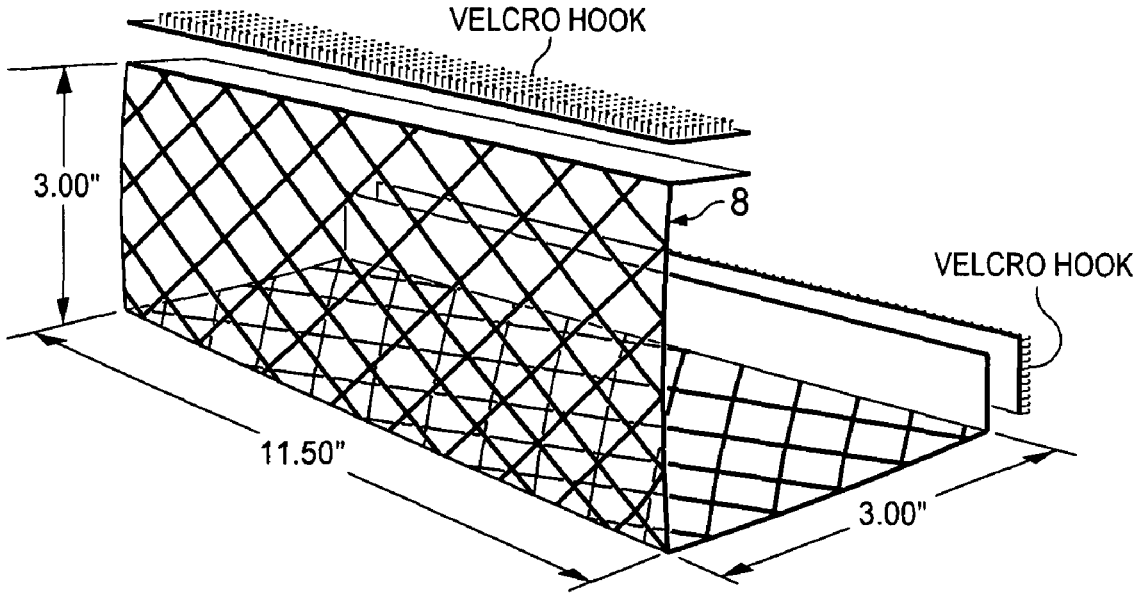
FIG. 5 is a detailed view of the baseball/softball equipment dugout organizer water bottle storage compartment.

FIG. 5 illustrates a mesh bottle holder 8, which is removably attachable to the compartments 5 using a hook and fastener material such as VELCRO.

Figure 6:
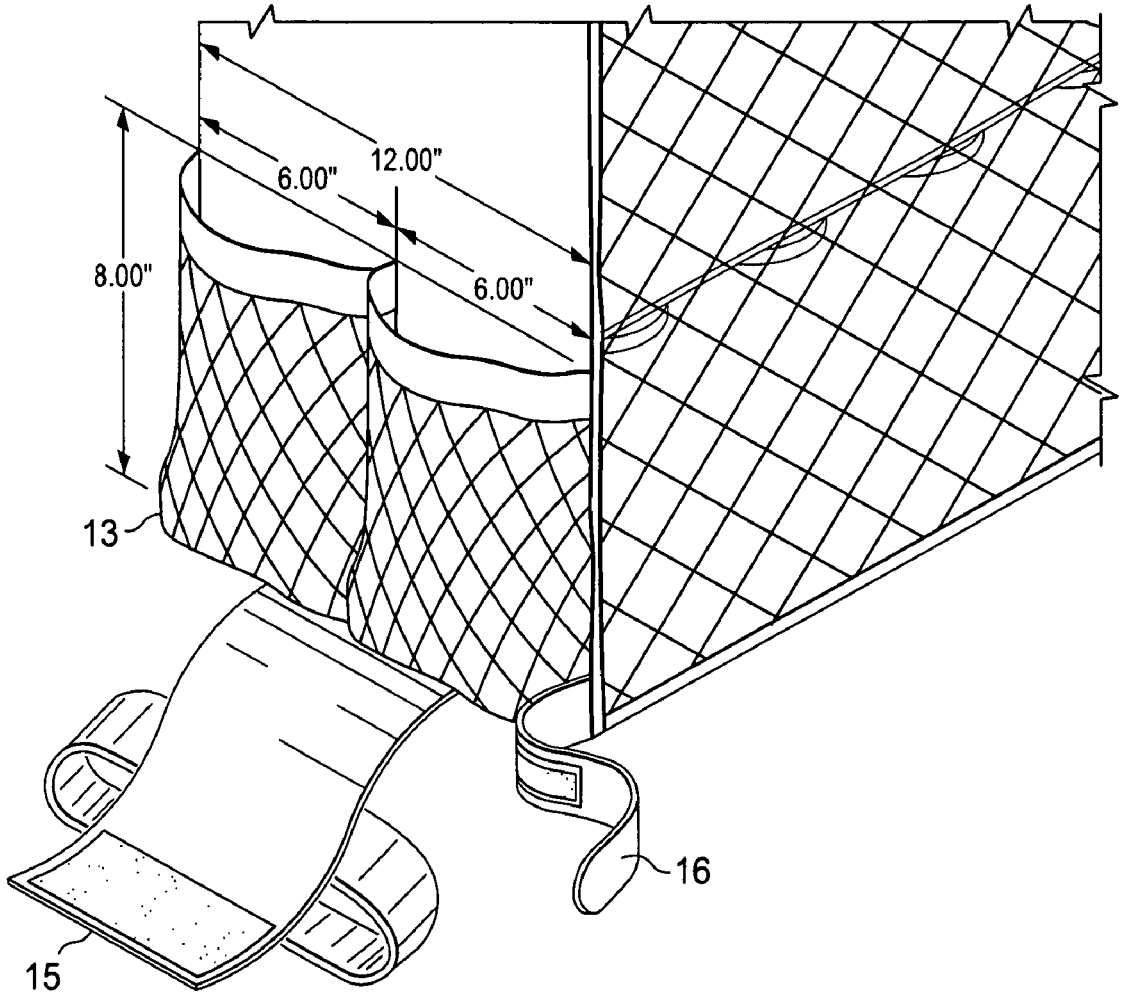
FIG. 6 is a detailed view of the baseball/softball equipment dugout organizer accessory storage pocket.
Figure 7:
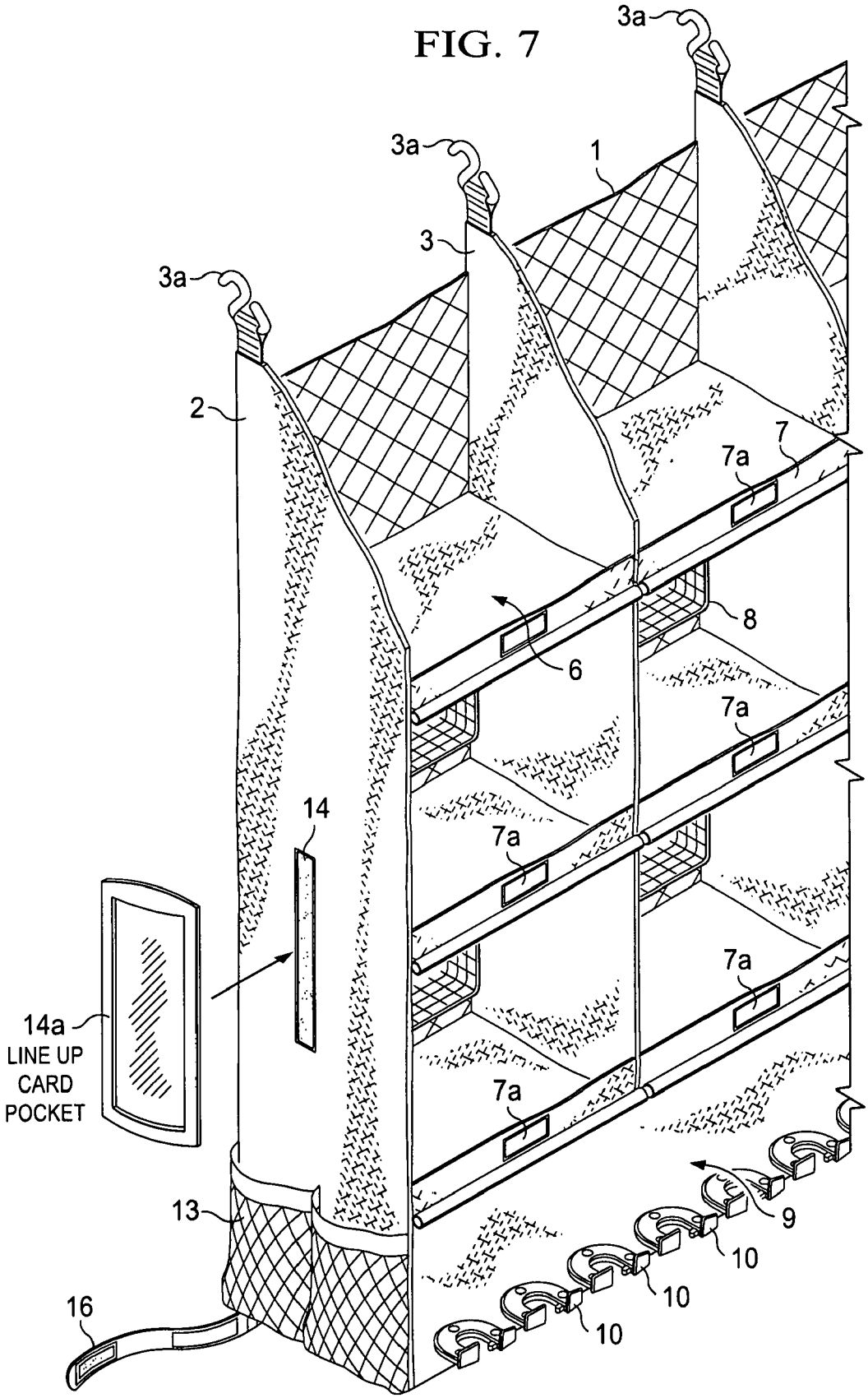
FIG. 7 is a detailed view of the baseball/softball equipment dugout organizer line-up card holder.

FIG. 6 illustrates details of the straps 16 for attaching the bottom of the organizer to a chain link fence, along with a close-up of the side storage pockets 13. The side storage pockets 13 can be used to hold baseballs, sunflower seed packets, bubble gum or other such items as may be typically found in a team's dugout FIG. 7 illustrates the line-up card feature, where a line-up card can be inserted into a pocket 14*a* which is removably attached to the side of the organizer. For example, a hook and loop material 14 can be used on the pocket to easily attach and remove the pocket 14*a* from the organizer.

Figure 8A:
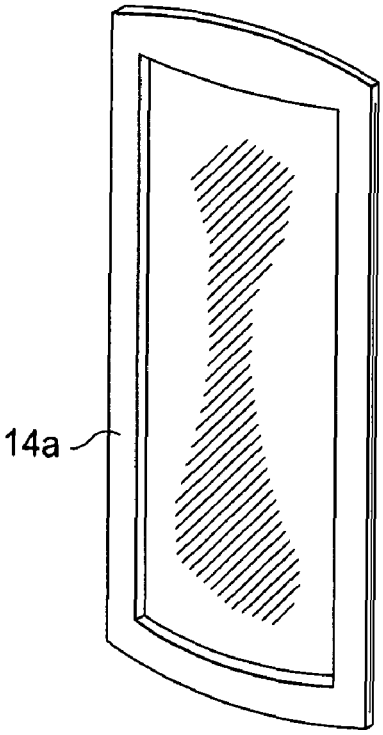
FIG. 8*a* through 8*c* illustrate a detailed view of the baseball/softball equipment dugout organizer line-up card pocket.
Figure 8B:
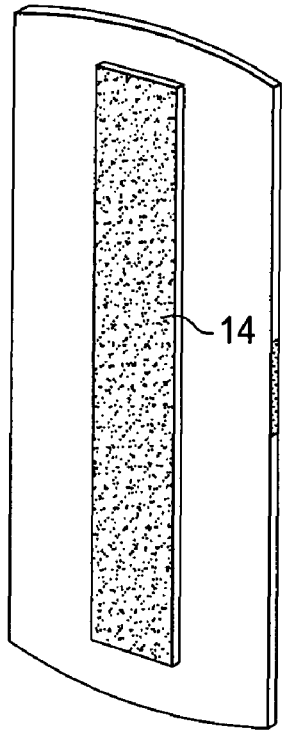
Figure 8C:
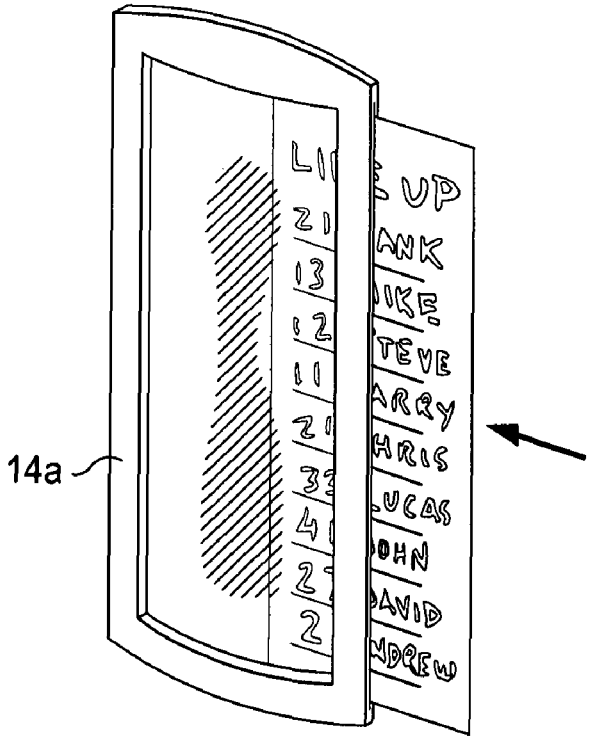

FIG. 8*a* illustrates a close up view of the line-up card pocket 14*a* and FIG. 8*b* illustrates a back view of the lineup card pocket 14*a*. As shown in FIG. 8*c*, in the preferred embodiment, the pocket is dimensioned to accept standard line-up cards which are available from a number of sources. The pocket 14 is approximately, ten inches high by five inches wide.

Figure 9:
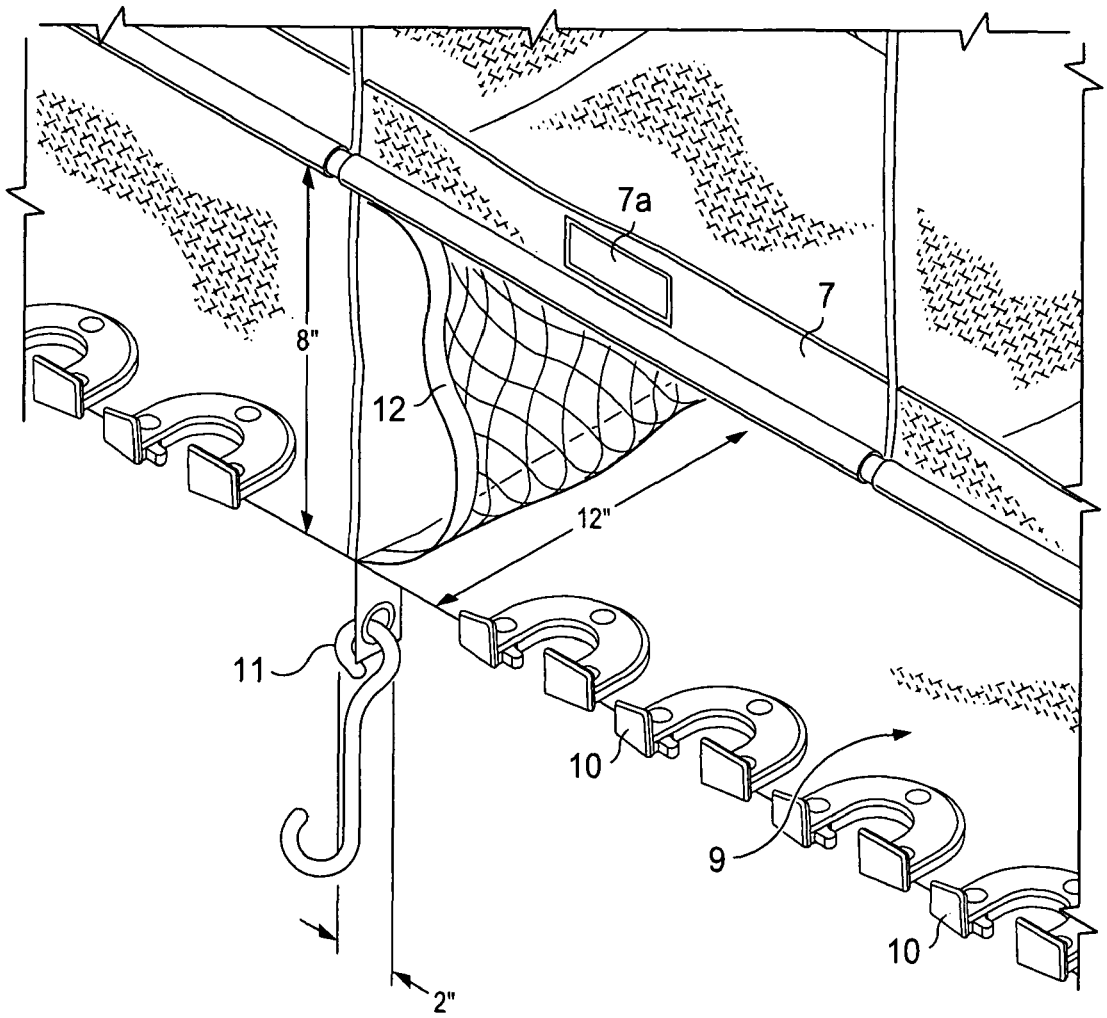
FIG. 9 is a detailed view of the baseball/softball equipment dugout organizer carry bag storage pocket.

FIG. 9 illustrates generalized dimensions for the bottom shelf 9 and the bag storage pocket 12, which stores the carrying bag while the organizer is being used.

Figure 10:
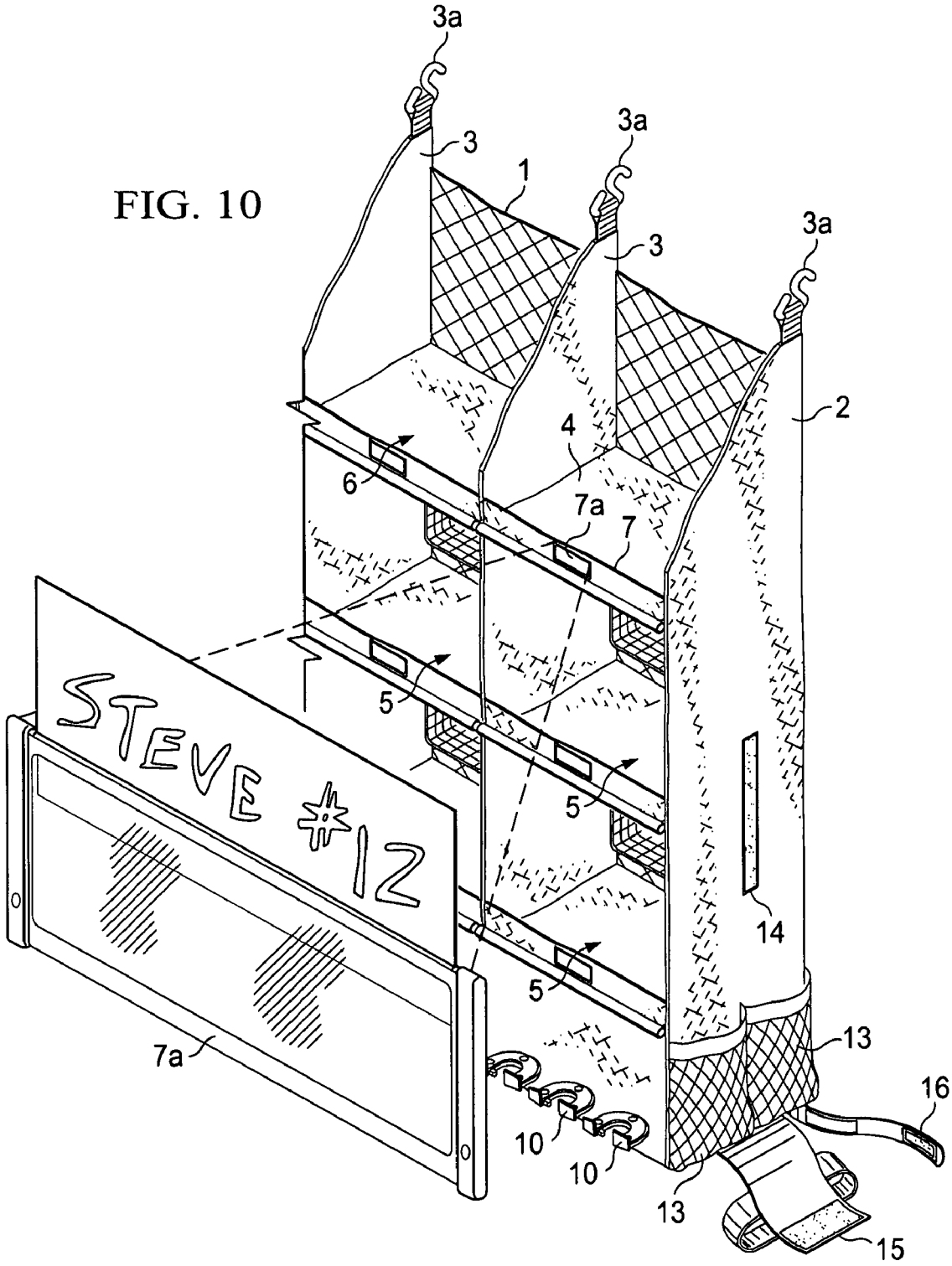
FIG. 10 is a detailed view of the baseball/softball equipment dugout organizer name tag pocket.

FIG. 10 illustrates a close up view of the name tag holders 7*a* for holding name tags of each of the players. The name tag holders 7*a* include a front clear plastic window and are preferably dimensioned 3.5" wide by 1.5" high. A paper name tag can be inserted behind the clear plastic window.

Figure 11:
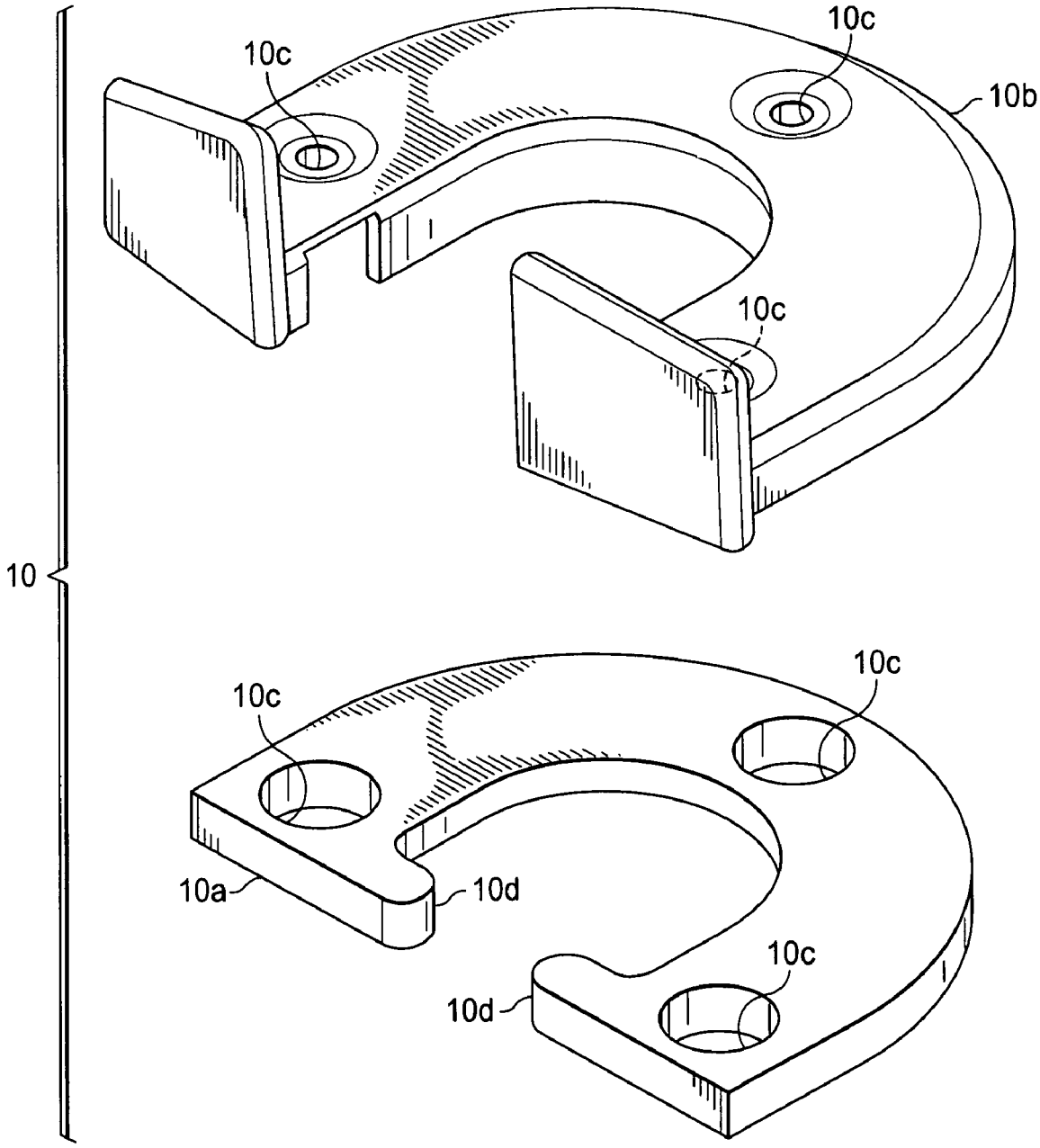
FIG. 11 is a detailed view of a first embodiment of a bat hanging mechanism.

FIG. 11 illustrates a detailed view of a preferred embodiment for the bat grabbers 10 for holding the player's bats. The bat grabbers 10 have a rubber catch portion 10*a* held within a plastic housing 10*b*. Both parts are secured to the shelf 9. In the illustrated embodiment, the grabbers 10 are secured using rivets through holes 10*c*. The catch portions 10*a* include protruding tips 10*d* which extend outward of the housing 10*b*. The tips deflect upon pressure to allow a bat to be placed within the grabber 10, but provide support along with lip 10*e* to prevent a bat from inadvertently falling out of the grabber 10, which could otherwise happen if the organizer is moved by contact within the dugout or by wind.

Figure 12:
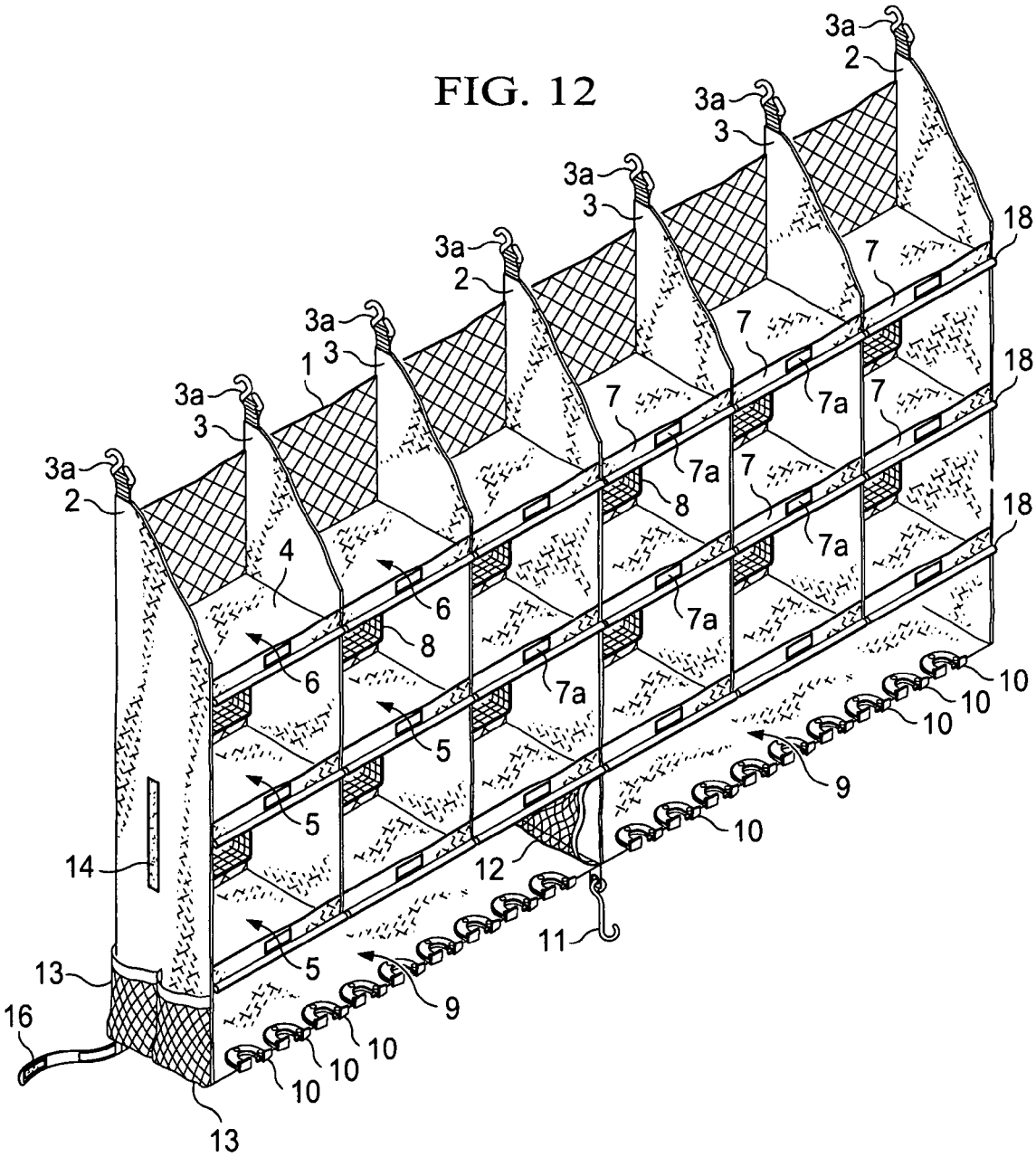
FIG. 12 is a detailed view of the baseball/softball equipment dugout organizer fiberglass support rods.

FIG. 12 illustrates rods disposed within edges of the compartments for maintaining the shape of the compartments as equipment is placed within the compartments. In the preferred embodiment, rods 18 are placed only along the front bottom edge of each compartment 5 and 6. The rods can be made from any light weight rigid material.

Figure 13:
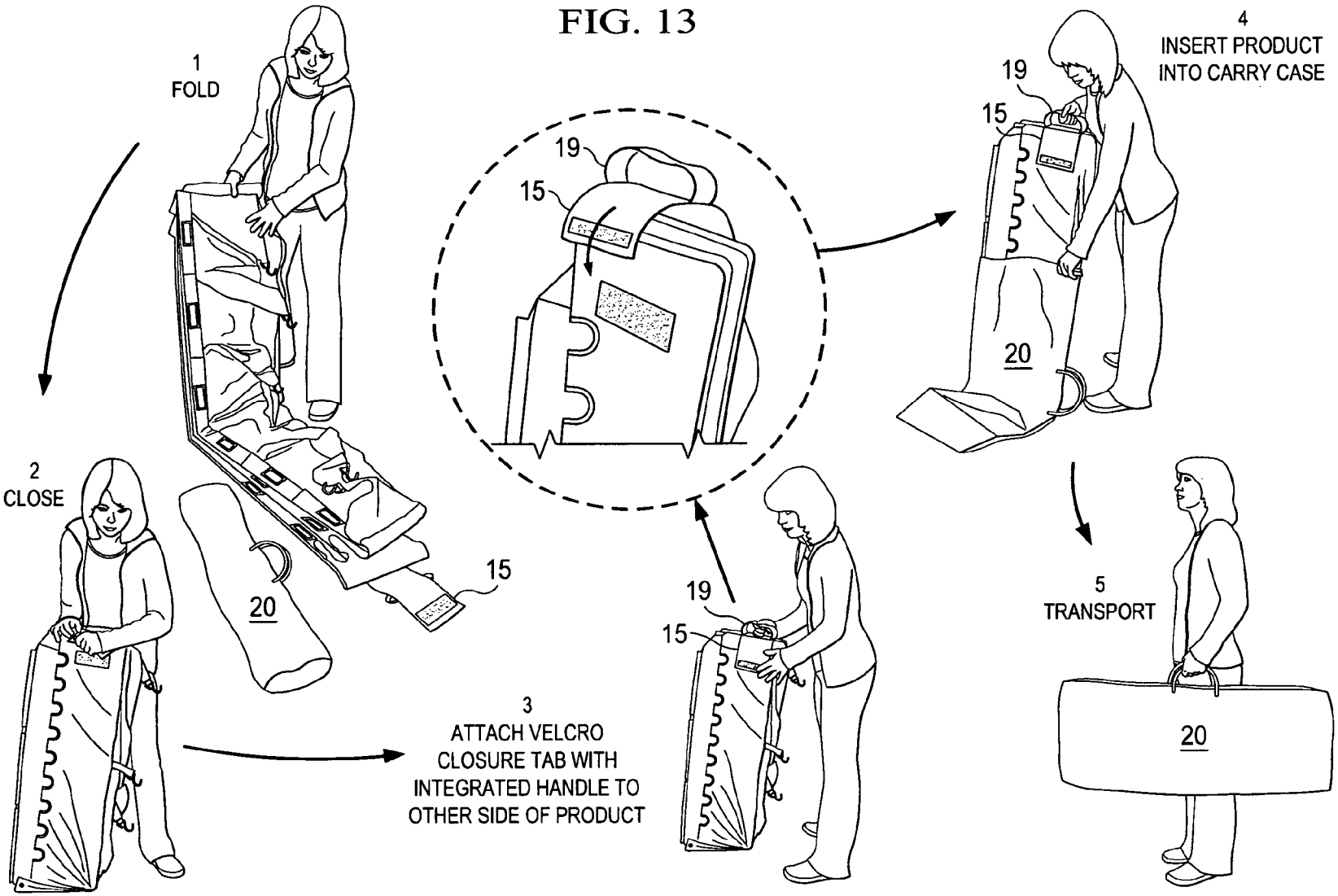
FIG. 13 shows folding and storage of the organizer.

FIG. 13 provides a general illustration folding the organizer for transportation and storage while not in use. The dugout organizer properties allow the unit to collapse straight downward into itself when not attached to the dugout fencing. It can then be folded in half and secured tightly closed, using a closure mechanism 15 shown in detail in FIG. 14. Once the unit is secured as such it can then be inserted into a custom sized carry bag 20 for ease of transport/portability and storage.

Figure 14:
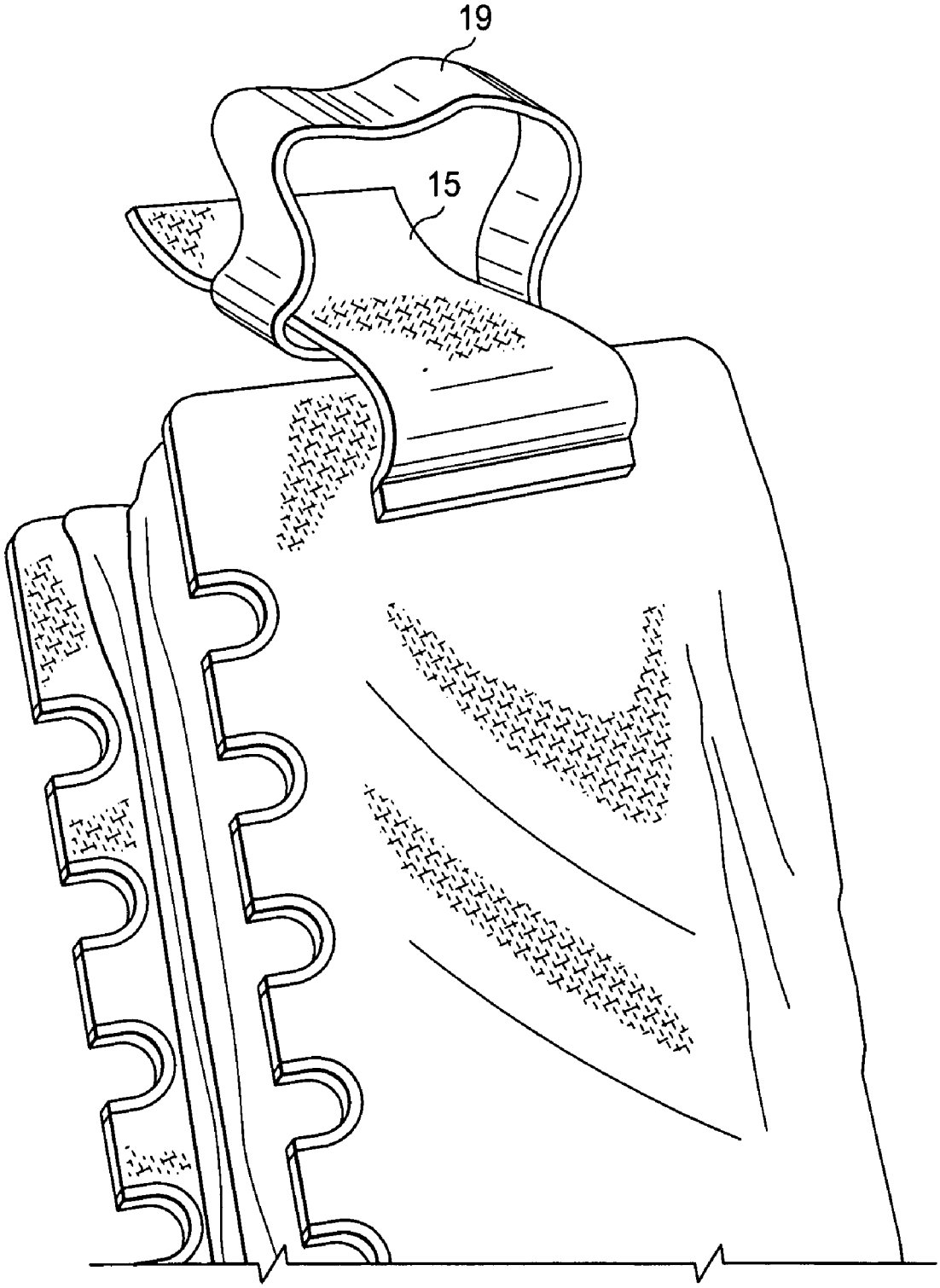
FIG. 14 shows a detailed view of a closure mechanism for holding the organizer in a folded state.

FIG. 14 provides a detailed view of the Velcro closure mechanism 15 whereby a material section is sewn to the underside of the unit and of sufficient length to wrap over the open end of the folded unit and thereby secured by a Velcro strip to its opposite Velcro strip sewn to the underside of the opposite section. Furthermore, attached to the material closure section is a handle strap 19 designed to allow for lifting and/or carrying the unit.

FIG. 15 illustrates a second embodiment of the bottom shelf and bat holders where a metal grid 30 having multiple extensions 32, where the bats may be hung between adjacent extensions. The metal grid could be, for example, a steel frame with PVC coating. The front of the extensions 32 are tilted upward to hold bats securely if the organizer is bumped or blown by the wind. A lightweight board 34, such as PE board, may be placed on top of the grid 30 for a smooth flat surface. The organizer would have two of the grids 30 so that the bottom shelf can be folded in two.

The present invention provides significant advantages over the prior art. First, it provides storage and organization of all the equipment for the entire team, and provides each player with an individual compartment for flexible storage of that player's personal equipment. Rather than providing spaces designated for specific equipment, the compartments of the organizer provide space to accommodate each player's individual gloves, hats, helmets, and so on, and other areas are provided for team property such as the line-up list. Providing spaces for eighteen players, along with the catcher's equipment, is more than adequate for most teams. While the invention is discussed in connection with a baseball/softball team, it could be used for other sports as well. Name cards designate each player's compartment. The name cards are replaceable so that the names can be replaced each season, or so that the same organizer can be used for two different teams.

Second, the organizer is light weight and collapses into a substantially flat shape when not in use. The flattened organizer can be carried by an integral handle and/or stored in a bag. Because there are no mechanical parts which need to be released to collapse the organizer, it can be easily folded or unfolded by a single person.

Third, when attached to a fence, the organizer provides all the functionality of a built-in organizer of the type used in a Major League dugout.

Although the Detailed Description of the invention has been directed to certain exemplary embodiments, various modifications of these embodiments, as well as alternative embodiments, will be suggested to those skilled in the art. The invention encompasses any modifications or alternative embodiments that fall within the scope of the Claims.

The invention claimed is:

1. A dugout organizer comprising:

an array of compartments formed from a flexible material, at least some of the compartment having at least four sidewalls, including two sides, a top, and a bottom defining a rectangular prism, wherein each of the compartments are sized to hold a player's glove, helmet and hat, with the array of compartments having a top layer and bottom layer;

a plurality of fasteners coupled to the top layer for fastening the organizer to a fence;

a plurality of bat holders for holding bats coupled to the bottom layer such that bats held in the bat holders hang beneath the compartments;

wherein all of the compartments collapse into themselves such that the compartments and bat holders can be folded into a relatively flat unit for transport.

2. The dugout organizer of claim 1 wherein said array of compartments includes at least twelve individual compartments.

3. The dugout organizer of claim 2 wherein each of said compartments has a backing portion.

4. The dugout organizer of claim 3 wherein said backing portion is a mesh material.

5. The dugout organizer of claim 1 wherein each compartment has a front barrier for preventing objects in the compartment from falling out of the compartment.

6. The dugout organizer of claim 5 wherein said front barrier includes a receptacle for a name card.

7. The dugout organizer of claim 1 and further comprising a shelf coupled to said array of compartments, wherein said shelf stores catcher's equipment.

8. The dugout organizer of claim 7, wherein the shelf is formed from a rigid grid.

9. The dugout organizer of claim 8, wherein the bat holders comprise extensions in the rigid grid.

10. The dugout organizer of claim 9, wherein the bat holders include an angled lip portion for maintaining a bat between the extensions.

11. The dugout organizer of claim 1 and further comprising a holder for a lineup card.

12. The dugout organizer of claim 1 and further including a hook for holding a catcher's mask.

13. The dugout organizer of claim 1 and further including a bag for holding the flat unit.

14. The dugout organizer of claim 13 and further comprising a storage pocket for holding the bag during use of the dugout organizer.

15. The dugout organizer of claim 1 wherein the fasteners comprise hooks attached to a top portion of the organizer for attaching to a fence.

16. The dugout organizer of claim 15 and further comprising mounting devices attached to a bottom portion of the organizer for attaching to the fence.

17. The dugout organizer of claim 1 wherein a plurality of compartments include a water bottle holder.

18. A dugout organizer comprising:

a plurality of compartments formed from a flexible material wherein each of the compartments are sized to hold a player's glove, helmet and hat;

a shelf for holding larger equipment coupled to the compartments having a rigid grid;

a plurality of bat holders for holding bats formed in the rigid grid;

wherein said compartments, shelf and bat holders can be folded into a relatively flat unit for transport.

19. The dugout organizer of claim 18 wherein the plurality of compartments includes at least twelve individual compartments.

20. The dugout organizer of claim 19, wherein each of said compartments has a backing portion.

21. The dugout organizer of claim 20, wherein said backing portion is a mesh material.

22. The dugout organizer of claim 18 wherein each compartment has a front barrier for preventing objects in the compartment from falling out of the compartment.

23. The dugout organizer of claim 22 wherein said front barrier includes a receptacle for a name card.

24. The dugout organizer of claim 18 and further comprising a shelf coupled to the compartments, wherein said shelf stores catcher's equipment.

25. The dugout organizer of claim 18, wherein the bat holders include an angled lip portion for maintaining a bat.

26. The dugout organizer of claim 18 and further comprising a holder for a lineup card.

27. The dugout organizer of claim 18 and further including a hook for holding a catcher's mask.

28. The dugout organizer of claim 18 and further including a bag for holding the flat unit.

29. The dugout organizer of claim 28 and further comprising a storage pocket for holding the bag during use of the dugout organizer.

30. The dugout organizer of claim 18 and further comprising hooks attached to a top portion of the organizer for attaching to a fence.

31. The dugout organizer of claim 30 and further comprising mounting devices attached to a bottom portion of the organizer for attaching to the fence.

32. The dugout organizer of claim 18 wherein a plurality of compartments include a water bottle holder.

33. A dugout organizer comprising:

a back having a top end and a bottom end;

vertical panels coupled to the back, at least one of the vertical panels including a fastener coupled thereto, the fastener being configured to support the back on a structure, at least one of the vertical panels extending from proximate the top end of the back to proximate the bottom end of the back; and horizontal pieces coupled to the back and to the vertical panels, the vertical panels and horizontal pieces collectively forming a grid of compartments and at least one shelf, each of the compartments is configured to receive a sports-related product and the shelf includes a holder configured to receive a portion of a bat and support the bat therefrom, wherein the back, the vertical panels, and the horizontal pieces can be folded into a relatively flat configuration for transportation;

wherein a first vertical panel has a different length than a second vertical panel, the at least one shelf has a different size and configuration than the compartments, one of the horizontal pieces forms a bottom of the organizer, and the first vertical panel extends from the top end of the back to the bottom horizontal piece.

34. A dugout organizer comprising:

an array of compartments formed from a flexible material, each compartment having at least three sidewalls, including two sides and a bottom defining a substantially rectangular prism, wherein each of the compartments is sized to hold a player's glove, helmet and hat and has a front barrier including a receptacle for a name card, the front barrier prevents objects in the compartment from falling out of the compartment;

a shelf for holding larger equipment coupled to the compartments; and a plurality of bat holders for holding bats coupled to the shelf;

wherein said compartments collapse into themselves, such that the compartments, shelf and bat holders can be folded into a relatively flat unit for transport.

* * * * *